US008272854B2

(12) United States Patent
Castronovo

(10) Patent No.: US 8,272,854 B2
(45) Date of Patent: Sep. 25, 2012

(54) VACUUM CLEANERS ESPECIALLY QUIET VACUUM CLEANERS, PUMPS, AND ENGINES

(76) Inventor: Charles A. Castronovo, Timonium, MD (US)

( * ) Notice: Subject to any disclaimer, the term of this patent is extended or adjusted under 35 U.S.C. 154(b) by 2301 days.

(21) Appl. No.: 11/117,631

(22) Filed: Apr. 29, 2005

(65) Prior Publication Data

US 2005/0241102 A1 Nov. 3, 2005

Related U.S. Application Data

(60) Provisional application No. 60/566,916, filed on May 3, 2004.

(51) Int. Cl.
*F04B 35/04* (2006.01)

(52) U.S. Cl. ..... 417/423.2; 417/410.3

(58) Field of Classification Search ..... 418/195; 417/410.3, 423.2
See application file for complete search history.

(56) References Cited

U.S. PATENT DOCUMENTS

| | | | | | |
|---|---|---|---|---|---|
| 44,901 | A | * | 11/1864 | Vining | 418/195 |
| 2,378,347 | A | | 6/1945 | Williams | |
| 2,994,098 | A | | 8/1961 | Fukuba | |
| 3,324,802 | A | * | 6/1967 | Fairbairn | 418/195 |
| 3,380,103 | A | | 4/1968 | Ritzau | |
| 3,410,477 | A | | 11/1968 | Hartley | |
| 3,897,756 | A | * | 8/1975 | Upchurch | 123/238 |
| RE28,717 | E | | 2/1976 | Smith | |
| 4,043,714 | A | * | 8/1977 | Berkowitz | 418/123 |
| 4,120,616 | A | | 10/1978 | Dwyer | |
| 4,159,133 | A | | 6/1979 | Belanger | |
| 4,187,997 | A | | 2/1980 | Mosciatti et al. | |
| 4,227,867 | A | * | 10/1980 | Whitehill et al. | 418/97 |
| 4,235,293 | A | | 11/1980 | Ellis | |
| 4,363,156 | A | | 12/1982 | Leinfelt | |
| 4,508,550 | A | | 4/1985 | Berfield et al. | |
| 4,547,927 | A | | 10/1985 | Berfield | |
| 4,586,214 | A | | 5/1986 | Berfield | |
| 4,669,952 | A | | 6/1987 | Forsyth, III et al. | |
| 4,683,608 | A | | 8/1987 | Berfield | |
| 4,723,969 | A | | 2/1988 | DeMarco | |
| 4,820,315 | A | | 4/1989 | DeMarco | |
| 4,921,510 | A | | 5/1990 | Plooy | |
| 4,976,002 | A | | 12/1990 | Leonov et al. | |
| 4,987,824 | A | | 1/1991 | Shinohara et al. | |
| 5,243,733 | A | | 9/1993 | Steiner et al. | |
| 5,502,869 | A | | 4/1996 | Smith et al. | |
| 5,645,379 | A | | 7/1997 | Stoner | |

(Continued)

FOREIGN PATENT DOCUMENTS

| | | |
|---|---|---|
| FR | 389 845 | 9/1908 |

(Continued)

*Primary Examiner* — Devon Kramer
*Assistant Examiner* — Dnyanesh Kasture
(74) *Attorney, Agent, or Firm* — Whitham Curtis Christofferosn & Cook, PC

(57) ABSTRACT

This impeller-free vacuum cleaner is based on a rotary piston. Vacuum suction of 300 inches of water or better can be delivered. Quietness of below 70 db can be delivered. Tongued rotary piston assemblies may be strategically placed, such as stacked, to eliminate vacuum suction dead zones. Sealing problems that otherwise were encountered with previous reciprocating and rotary piston structures for vacuum cleaners are solved by using a tongued rotary piston with a double-notched rotary valve operating by a Geneva mechanism, and a novel pancake-shaped cylindrical structure to house the rotary piston. An inventive rotary combustion engine also is disclosed.

1 Claim, 11 Drawing Sheets

U.S. PATENT DOCUMENTS

| | | | | |
|---|---|---|---|---|
| 5,788,463 | A | | 8/1998 | Chan |
| 5,797,366 | A | | 8/1998 | Adamovski |
| 5,818,059 | A | * | 10/1998 | Coyne et al. ..... 250/507.1 |
| 5,899,653 | A | | 5/1999 | Brodine |
| 5,951,268 | A | | 9/1999 | Pottier et al. |
| 6,014,791 | A | | 1/2000 | Nosenchuck |
| 6,023,830 | A | | 2/2000 | Cole et al. |
| 6,026,541 | A | | 2/2000 | Bailey et al. |
| 6,052,863 | A | * | 4/2000 | Rittmueller et al. ..... 15/326 |
| 6,058,561 | A | | 5/2000 | Song et al. |
| 6,065,499 | A | | 5/2000 | Pless et al. |
| 6,081,961 | A | | 7/2000 | Wang |
| 6,231,054 | B1 | | 5/2001 | Allen, Jr. et al. |
| 6,499,385 | B2 | | 12/2002 | Protti |
| 6,779,228 | B2 | | 8/2004 | Plomteux et al. |
| 6,804,857 | B1 | | 10/2004 | Olewiler, III et al. |
| 6,836,930 | B2 | | 1/2005 | Thur et al. |
| 2003/0019460 | A1 | | 1/2003 | Tezuka |
| 2003/0037408 | A1 | | 2/2003 | Park |
| 2003/0146631 | A1 | | 8/2003 | Stoev |
| 2005/0011036 | A1 | | 1/2005 | McCutchen |
| 2005/0246859 | A1 | | 11/2005 | Castronovo |

FOREIGN PATENT DOCUMENTS

| | | |
|---|---|---|
| FR | 430 206 | 10/1911 |
| GB | 169 831 | 10/1921 |

* cited by examiner

102

111X
111
110L
110R
102
120R
104
104R
104L
105
100
101
103
120L

102

111X
RESIDUE FLOW
110L
110R
120R
120L

111X
RESIDUE FLOW
110L
110R
120R
120L

Figure 5F
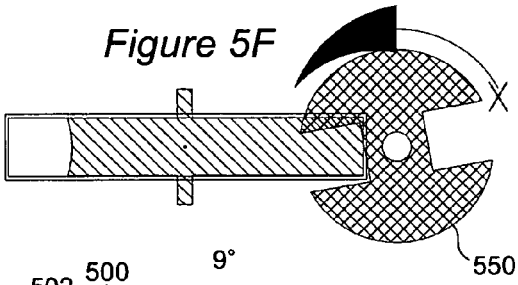
Figure 5G
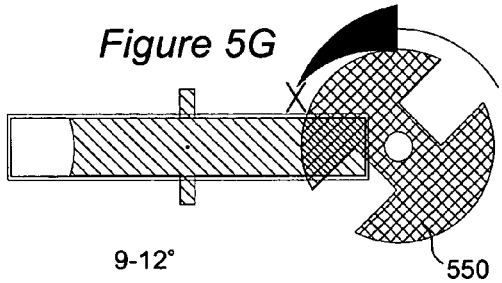
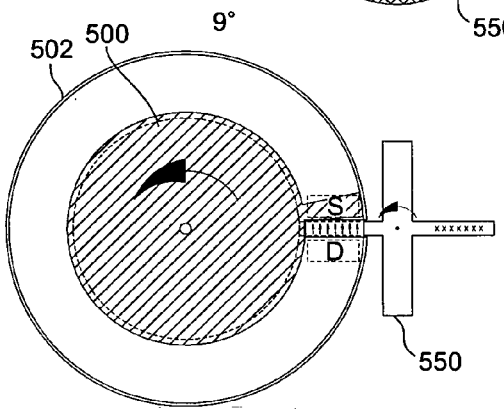
Figure 5FF
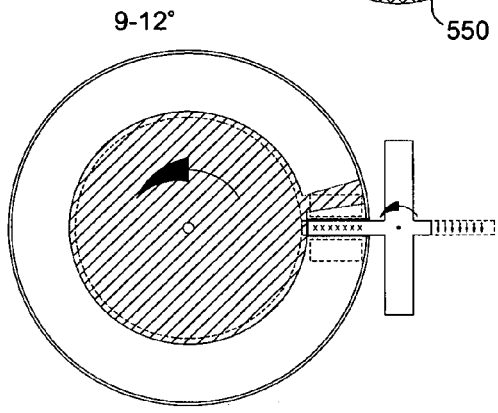
Figure 5GG
Figure 5H
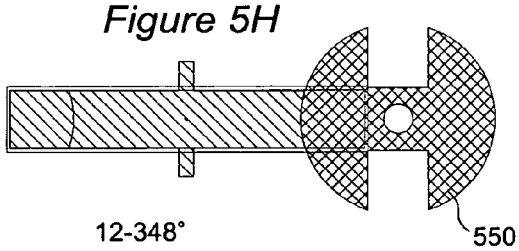
Figure 5I
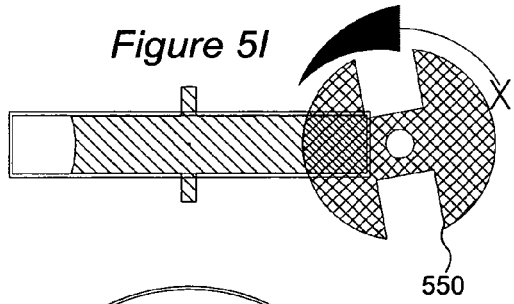
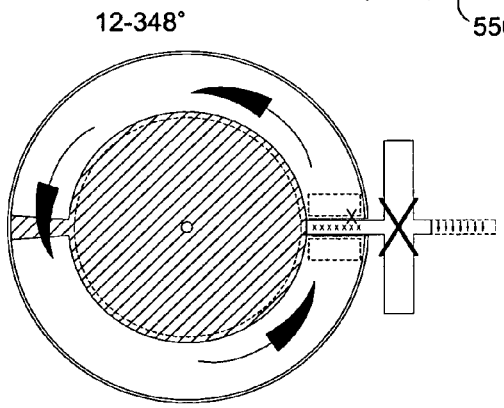
Figure 5HH
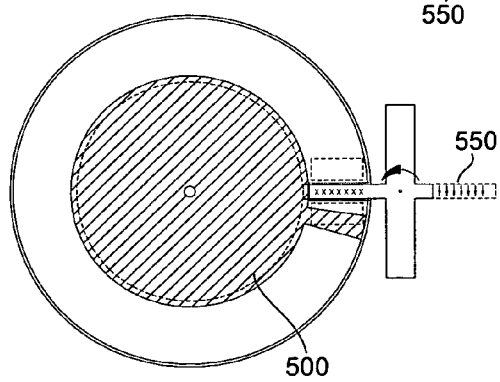
Figure 5II Figure 5J
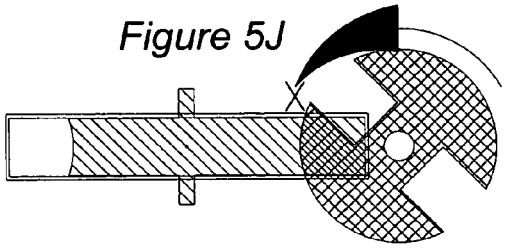
348-352°
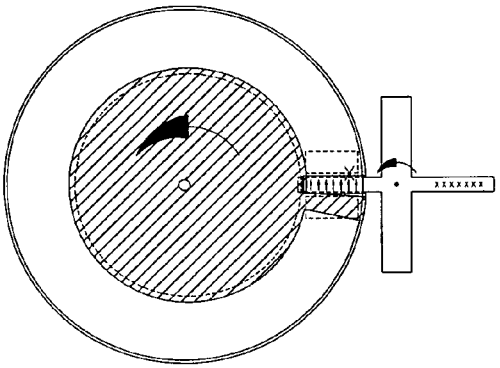
Figure 5JJ
Figure 5K
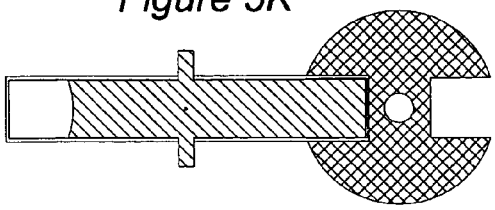
352°
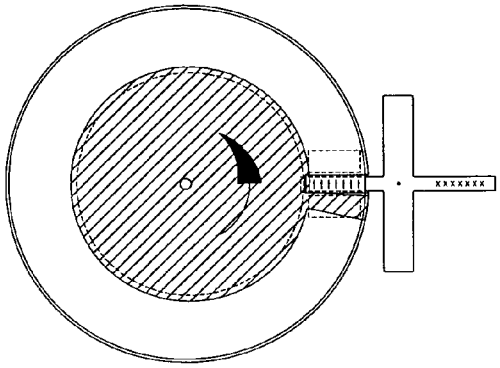
Figure 5KK
Figure 5L
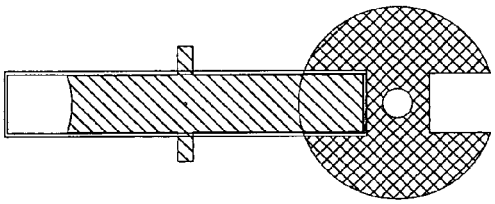
360°
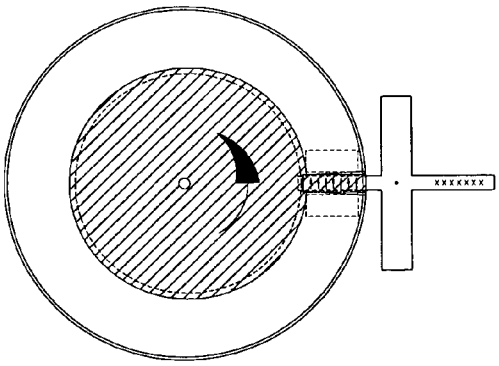
Figure 5LL
Figure 5M
STOPPED
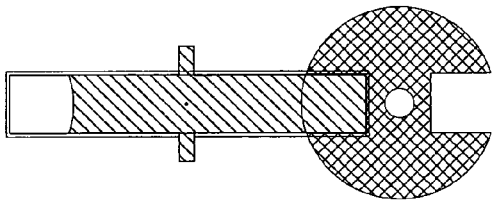
8°
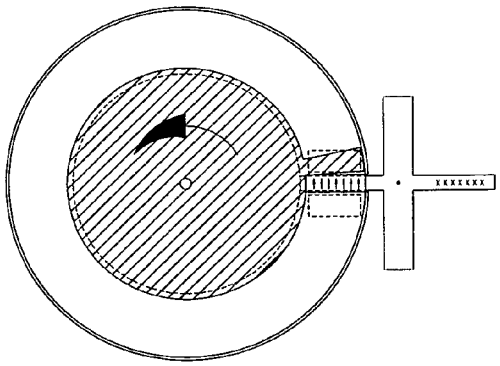
Figure 5MM

VACUUM CLEANERS ESPECIALLY QUIET VACUUM CLEANERS, PUMPS, AND ENGINES

RELATED APPLICATION

This claims benefit of U.S. provisional application Ser. No. 60/566,916 filed May 3, 2004 titled "Silent Vacuum Unit."

FIELD OF THE INVENTION

The present invention generally relates to vacuum cleaning.

BACKGROUND

A large number of vacuum cleaners are known, whether for processing dust or liquids. Most vacuum cleaners very commonly rely on a rotating impeller structure, but other structures have been disclosed. Some vacuum cleaners that have been disclosed in the literature are as follows: U.S. Pat. No. 4,683,608 (Berfield et al.) for "Alternate blower outlet for vacuum cleaner" issued Aug. 4, 1987 to Shop-Vac Corp.; U.S. Pat. No. 6,499,385 (Protti) for "Hand vacuum pump with linear piston actuation" issued Dec. 31, 2002 to Innova Electronics Corp.; U.S. Pat. No. 5,788,463 (Chan) for "Manual vacuum producing system having pressure indicator" issued Aug. 4, 1998; U.S. Pat. No. 4,921,510 (Plooy) for "Vacuum cleaner system" issued May 1, 1990; U.S. Pat. No. 6,836,930 (Thur et al.) for "Airflow indicator" issued Jan. 4, 2005 to Royal Appliance Mfg. Co.; U.S. Pat. No. 6,058,561 (Song et al.) for "Vacuum cleaner suction apparatus" issued May 9, 2000 to Samsung Kwangju Electronics Co., Ltd.; U.S. Pat. Pub. No. 2003/0037408 (Park, LG Electronics Inc.) for "Suction head for vacuum cleaner" published Feb. 27, 2003; U.S. Pat. No. 4,363,156 (Leinfelt) for "Vacuum cleaner dust container having compressing means associated therewith" issued Dec. 14, 1982 to Aktiebolaget Electrolux; U.S. Pat. No. 4,508,550 (Berfield et al.) for "Air flow responsive outlet from tank of vacuum cleaner" issued Apr. 2, 1985 to Shop-Vac Corp.; U.S. Pat. No. 4,976,002 (Leonov et al.) for "Tube particle vacuum cleaner" issued Dec. 11, 1990 to Intel Corp.; U.S. Pat. No. 6,026,541 (Bailey et al.) for "Multi-purpose attachment tool for a hand-held vacuum cleaner" issued Feb. 22, 2000; U.S. Pat. No. 6,081,961 (Wang) for "Portable vacuum cleaner" issued Jul. 4, 2000; US 2003/0146631 (Stoev) published Aug. 7, 2003 for "Vacuum pet litter remover"; U.S. Pat. Nos. 4,820,315 and 4,723,969 (both to DeMarco) for "Vacuum loader and process for removing asbestos and other particulate material" issued Apr. 11, 1989 and Feb. 9, 1988 respectively; US 2005/0011036 (McCutchen) published Jan. 20, 2005 for "Ambient air backflushed filter vacuum."

Also, U.S. Pat. No. 4,159,133 (Belanger) for "Flexible vacuum bellows" issued Jun. 26, 1979 to Air Products and Chemicals, Inc.; U.S. Pat. No. 5,899,653 (Brodine) for "Two-stage vacuum bellows" issued May 4, 1999 to Applied Materials, Inc.; U.S. Pat. No. 5,951,268 (Pottier et al.) for "Sperial vacuum pump having a metal bellows for limiting circular translation movement" issued Sep. 14, 1999 to Societe des Brevets P. Vulliez; U.S. Pat. No. 6,065,499 (Pless et al.) for "Lateral stress relief mechanism for vacuum bellows" issued May 23, 2000 to Eaton Corp.; U.S. Pat. No. 6,231,054 (Allen et al.) for "Elastomeric sliding seal for vacuum bellows" issued May 15, 2001 to Axcelis Technologies, Inc.

When a rotating impeller is used in a vacuum cleaner, the impeller must be rotated at a high speed to produce sufficient suction, and a byproduct is a high siren scream noise. Thus vacuum cleaners have been very noisy.

There have been many attempts to make vacuum systems somehow more quiet. See U.S. Pat. No. 4,120,616 by Dwyer et al. issued Oct. 17, 1978 to Breuer Electric Mfg. Co. (for "Vacuum cleaner-blower assembly with sound absorbing arrangement"); U.S. Pat. No. 4,987,824 by Shinohara et al. issued Jan. 29, 1991 to Nissin Kogyo Kabushiki Kaisha (for "Tandem-type vacuum booster with noise suppressing air passage"); U.S. Pat. No. 6,023,830 by Cole et al. issued Feb. 15, 2000 to Dana Corp. (for "Apparatus and method for installing a noise reduction structure within a vehicle drive-shaft tube"); U.S. Pat. No. 6,779,228 by Plomteux et al. issued Aug. 24, 2004 (for "Quiet central vacuum power unit"); U.S. Pat. No. 5,502,869 by Smith et al. issued Apr. 2, 1996 to Noise Cancellation Technologies, Inc. (for "High volume, high performance, ultra quiet vacuum cleaner"); U.S. Pat. No. 6,804,857 by Olewiler, III issued Oct. 19, 2004 to M.D. Manufacturing, Inc. (for "Apparatus for dampening the noise of a vacuum cleaner"); U.S. Pat. No. 4,187,997 by Mosciatti et al. issued Feb. 12, 1980 (for "Vacuum control system for magnetic tape handler" where the elimination of belts, gears and high speed blowers is said to result in an unusually quiet system); U.S. Pat. No. 4,669,952 by Forsyth, III et al. issued Jun. 2, 1987 to Ametek, Inc. (for "Quiet by-pass vacuum motor"); U.S. Pat. Nos. 4,547,927 and 4,586,214 both by Berfield issued Oct. 22, 1985 and May 6, 1986 respectively to Shop-Vac Corp. (both for "Compact vacuum cleaner" said to maintain quiet conditions in spite of high speed air flow).

U.S. Pat. No. 6,014,791 (Nosenchuck) for "Quiet vacuum cleaner using a vacuum pump with a lobed chamber" issued Jan. 18, 2000 to SounDesign, LLC, instead of a traditional impeller, used a lobed (Wankel-type) vacuum pump. In his Background section, Nosenchuck mentioned but expressly taught away (~col. 1, line 64+) from using a reciprocating piston structure, and taught using a lobed (Wankel-type) vacuum pump to avoid a traditional impeller.

Another aspect of vacuum cleaners is their suction performance. Conventional, commercially available centrifugal-impeller vacuum devices have suction performance (generally measured in inches of water-column, with the vacuum inlet sealed, to obtain maximum static suction) in the range of 40 to 145 inches. A typical household vacuum cleaner has suction of about 40-60 inches of water; a typical low cost shop-type canister style vacuum cleaner has suction of about 60-80 inches of water; a high performance shop and industrial vacuum cleaner has suction of about 100-145 inches of water. (It will be appreciated that suction measurement being expressed in terms of inches of water does not mean that the device is necessarily used for vacuuming water as opposed to vacuuming dust, etc.) At the top end of the vacuum suction performance hierarchy (i.e., 120-145 inches of water), the centrifugal-impeller conventional vacuum 'head" will have two or three "stages," which are cascaded together and typically driven by a common motor shaft, to obtain the suction performance. This is a costly and complex assembly of components.

Theoretically, on paper, the absolute maximum possible performance, a "hard" vacuum, would be about 407 inches of water at sea level in a "standard" atmosphere, using a "perfect" vacuum unit. However, a vacuum suction of 300 inches of water might be impossible to obtain using centrifugal-impeller schemes, and would certainly be prohibitively expensive, prohibitively complex, and would have minimal volume flow capability at such a high suction level. The cause of this difficulty is the mechanical "slip" or leakage inherent in the basic impeller scheme, whereby the motion of the air particles is not positively controlled. The air is not positively captured. Rather, the air is pushed in a manner very much like sweeping water uphill with a loose-bristle broom. When broom-sweeping rapidly enough, the water will move uphill, and will not easily fall back. Yet some of the water will "slip" or leak through the loose broom bristles, no matter how hard or how fast you sweep. Similarly, when vacuuming with an impeller device, some air molecules will always "slip" or leak past and flow around the impeller blades in a practical conventional centrifugal-impeller vacuum device, no matter how carefully it is constructed.

In a conventional impeller style vacuum device, the internal rotating part spins at a fast speed so that an air particle is accelerated out radially and eventually exits. Centrifugal vacuum pumps (also known as vacuum blowers) are compression suction devices. Inevitably the air particles in these conventional impeller style vacuum devices experience a non-negligible amount of "slip" because nothing is positively forcing air out. Various valving mechanisms have been attempted to keep "slip" under control, but without full success. "Slip" has not been overcome in impeller-style vacuum devices, and suction has not been as strong as would be wanted. For high volumes of air, air is at relatively low static suction, making delivery of high vacuum difficult because of the slip problem. The approach conventionally used has been a multistage approach, which has been difficult to implement and has not solved the problem.

Most shop vacuums are clean impeller pumps (as contrasted with a dirty impeller pump which moves something besides air). In household vacuuming, air is drawn through a large bag and then exhausted. Light weight motors can be used that drive the impeller relatively fast, as is needed, but along with the fast movement necessarily comes the high noise factor. However, slowing the impeller movement is unacceptable because sufficient working suction is then not provided.

Some positive displacement vacuum devices have been suggested over the years, but have not been able to be made to process enough air volume. For example, in household or industrial vacuum cleaning of carpets, a certain air volume is needed to entrain a particle in the air flow to get the particle released from the carpet (i.e., to overcome static forces, stiction, etc.). The conventional devices use a nozzle or the like, and there necessarily is a distance from the nozzle to the backing of the carpet by virtue of the structure of the carpet. In conventional devices, much air must be sucked in order to be able to entrain particles in the carpet. Conventional high vacuum devices generally only work on a very small section of carpet (such as when the wide suction implement is taken off a conventional vacuum cleaner, and a small nozzle is used instead).

In addition to the suction limitations of an impeller-style vacuum cleaner, the impeller structure, as has been mentioned is noisy (sometimes referred to as a "siren scream" caused by pulsations of sound by air pushed by impeller blades). The unmet demand for vacuum cleaner quietness continues. Impeller structures remain relatively noisy. Impeller-free structures have yet to be as successful as may be wanted for other requirements, such as suction and amount of material handled. Balancing the desired features of vacuum cleaners (such as suction, quietness, amount of material handled, etc.) remains an unsolved problem. For example, a high-suction, quiet vacuum is not yet known.

SUMMARY OF THE INVENTION

For pumping fluid and/or air, certain positive piston devices have been invented. The present invention avoids major problems of impeller-containing vacuum devices, by providing an inventive impeller-free positive-displacement vacuum device, thereby minimizing slip (which necessarily is present in impeller-containing vacuum schemes) and thus providing much higher suction performance than can be achieved in impeller vacuum schemes.

In a preferred embodiment, the invention provides a vacuum cleaner, wherein no centrifugal impeller is included and wherein a siren scream noise is not made, wherein the vacuum cleaner delivers a vacuum suction of at least about 300 inches of water, such as, e.g., a vacuum cleaner including a positive displacement vacuum system (such as, e.g., a positive displacement vacuum system (such as, e.g., a system including a reciprocating piston structure; a system including a bellows structure; and a system including a diaphragm structure; etc.)); a vacuum cleaner wherein air is pumped; a vacuum cleaner wherein a liquid is pumped; a vacuum cleaner having an exterior size of no bigger than about 6 inches by 6 inches by 6 inches; etc.

Another inventive embodiment that is preferred provides an impeller-free vacuum cleaner, comprising: a reciprocating piston actuated by a diamond level wind screw; such as, e.g., a vacuum cleaner wherein the reciprocating piston is prevented from rotating; etc.

The invention in another preferred embodiment provides a vacuum cleaner comprising a double-acting piston (such as, e.g., a piston having a surface area of about 1 inch by 1 inch; a piston having a hub wherein the piston hub has a peripheral concave surface; etc.).

Also, the invention in a further preferred embodiment provides a vacuum cleaner comprising at least one rotary piston (such as, e.g., a rotary piston disposed in a hollow, closed chamber (such as, e.g., a chamber having a shape that is, e.g., cylindrical, toroidal, rectangular toroidal, etc.); a rotary piston having a tongue (such as, e.g., a rotary piston tongue that pushes (compresses) air in front of the tongue and creates a vacuum behind the tongue)). There also may be included in the vacuum cleaner a rotary valve which is capable of moving (such as, e.g., a rotary valve that includes an intake passage and a discharge passage), such as, e.g., vacuum cleaners in which (the piston having a rotational axis and the valve having a rotational axis) the piston axis is parallel to the valve axis; vacuum cleaners in which (the piston having a rotational axis and the rotary valve having a rotational axis) the rotary valve axis is 90 degrees offset; vacuum cleaners having a chamber and a rotary valve wherein the chamber includes an opening through which can move the rotary valve; etc.

The invention in another preferred embodiment provides a vacuum cleaner, comprising a stack of at least two rotary pistons, each rotary piston disposed in a respective hollow, closed chamber (such as, e.g., a closed chamber having a shape that is cylindrical, toroidal, rectangular toroidal, etc.), such as, e.g., vacuum cleaners wherein motion of the rotary pistons is synchronized so that when one rotary piston is dormant, at least one other rotary piston is active; vacuum cleaners wherein the stack includes exactly two rotary pistons-with-chambers stacked, and each rotary piston-with-chamber has associated therewith a rotary valve, wherein when viewed from above the respective rotary valves are on opposite sides; vacuum cleaners wherein the stack includes four rotary pistons-with-chambers stacked, and each rotary piston-with-chamber has associated therewith a rotary valve, wherein when viewed from above the respective rotary valves are positioned at 0, 90, 180 and 270 degree positions; etc.

In another preferred embodiment the invention provides a vacuum cleaner comprising a set of at least two tongued rotary pistons in a single chamber, the piston tongues being staggered to minimize dormant zones.

Additionally, in another preferred embodiment the invention provides a vacuum cleaner comprising a Geneva mechanism.

In a further preferred embodiment, the invention provides rotary combustion engines, such as, e.g., a rotary combustion engine without any trochoidal or elliptical chamber; a rotary combustion engine including a piston that follows pure circular motion (without needing to reciprocate or reverse direction or even vary in speed); a rotary piston engine whose piston does not reciprocate; a rotary piston engine whose piston need not speed up or slow down in order to operate properly; and other inventive rotary combustion engines.

BRIEF DESCRIPTION OF THE DRAWINGS

The foregoing and other objects, aspects and advantages will be better understood from the following detailed description of a preferred embodiment of the invention with reference to the drawings, in which:

FIG. 1 is a cross-sectional view. FIG. 1L and FIG. 1R are respective left end and right end views of FIG. 1, with the intake manifold not shown. FIGS. 1A and 1B are from the same perspective as FIG. 1, at different times in an operational cycle.

In FIG. 2, a rotating crank mechanism is shown operating two opposite bellows.

FIGS. 5F, 5G, 5H, 5I, 5J, 5K, 5L, 5M are a sequence showing (as side views) the inventive parts of FIGS. 5, 5A, 5B, 5C, 5D, 5E in operation. FIGS. 5FF, 5GG, 5HH, 5II, 5JJ, 5KK, 5LL, 5MM are another view and respectively correspond to FIGS. 5F, 5G, 5H, 5I, 5J, 5K, 5L, 5M.

DETAILED DESCRIPTION OF PREFERRED EMBODIMENTS OF THE INVENTION

The question was presented that a conventional-style impeller vacuum device (in a machine that vacuumed dust) was noisier than was wanted. For the particular application under consideration, a high vacuum was demanded with minimal sound pollution. The present inventor determined to avoid the impeller structure and instead use a positive displacement approach (such as, e.g., a piston-type approach; a diaphragm approach; etc.).

Figures 1, 1A, 1B, 1L, 1R:
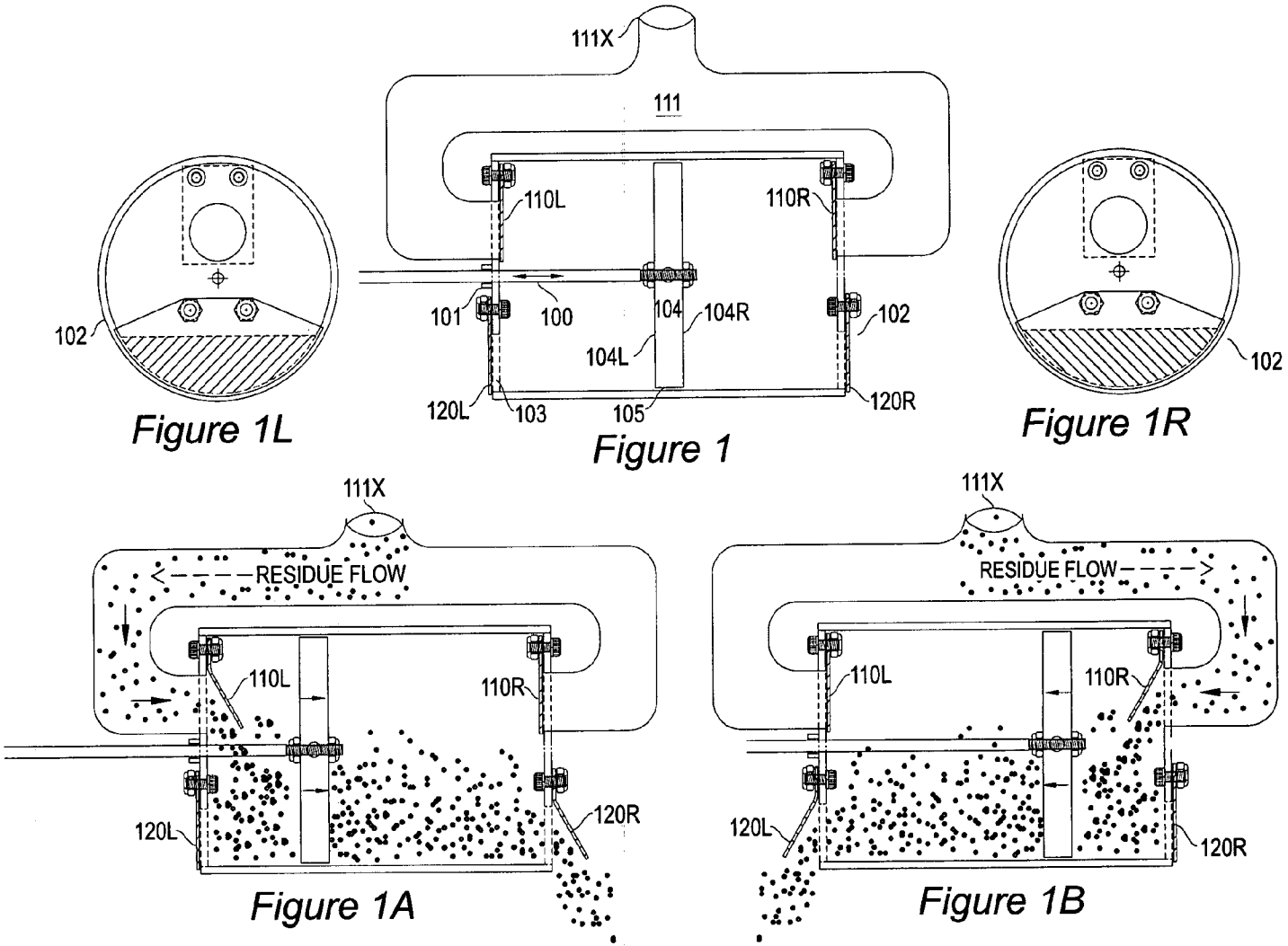
FIGS. 1, 1L, 1R, 1A and 1B show different views of an embodiment of an inventive positive displacement vacuum device.

Referring to FIGS. 1, 1R and 1L, in a basic inventive embodiment, a vacuum cleaner device including a reciprocating piston rod 100 may be used. (The reciprocating piston rod 100 is shown as reciprocating left and right in FIG. 1. However, it will be appreciated that the inventive device may be built in other configurations, such as a piston that reciprocates up and down, etc.)

As shown in FIG. 1, the piston rod 100 is disposed inside a container (such as cylinder 102) using a loose piston rod seal 101. (Although the container shown in FIGS. 1, 1R and 1L is a cylinder 102, the container may take other shapes.) A smile-shaped opening 103 is at each end of the cylinder 102. The reciprocating piston rod 100 drives a piston 104. The piston 104 has a loose seal 105 with the inside of cylinder 102. Seals 101 and 105 are loose so that no lubrication is required; frictional heat buildup is minimized; manufacturing cost is minimized; and complexity is minimized.

As shown in FIG. 1, the cylinder 102 has openings for a flapper valve (left intake) 110L and a flapper valve (right intake) 110R. Flapper valves (intakes) 110L,11OR connect the interior of the cylinder 102 with the intake manifold 111. Intake manifold 111 includes tubing 111X which connects to a source of residue (such as, e.g., a source of dust of a high-security size which has been generated from a material being destroyed (such as by zero-clearance destruction of a compact disk, paper, SMART cards, or some combination of such materials); a source of household dust; etc.).

As shown in FIG. 1, cylinder 102/intake manifold 111 has flapper valve left exhaust 120L and flapper valve right exhaust 120R.

Piston rod 100, piston 104, cylinder 102, and intake manifold 111 may be made, for example, from low-cost plastic mouldings, or from other materials. Flapper valves 110L, 110R, 120L, 120R may be, for example, die-cut from neoprene or similar rubber-like material.

For actuating the piston rod 100, there may be used a piston rod actuator such as a linear motor, solenoids, a classic crank and connecting rod scheme, etc. The piston 104 preferably is driven back and forth by a motor (such as, e.g., a cranking motor, a linear motor, etc.). For example, a basic concept (as scaled for use in this invention) may be that of a rescue winch from a Coast Guard helicopter, in which a diamond-pattern grooved screw rotates in the same direction continuously. Likewise, there may be provided for use in the inventive vacuum cleaner a shaft that drives a ring continuously in one direction, without the shaft reversing, so that back and forth motion of the reciprocating rod 100 is provided. For example, a diamond level wind screw (such as in a Pinnacle brand fishing rod model CRTLP10) may be used to actuate the reciprocating piston 104.

When thus actuating a piston 104, preferably the piston 104 is prevented from rotating, such as by positioning the piston 104 on a secondary shaft disposed near the periphery of the piston. Another approach for preventing rotation of piston 104 is to include a slot and dog on the piston and cylinder. Also, piston rotation may be prevented by forming the piston 104 of an inherently nonrotating shape such as a square or a hexagonal piston riding in a rectangular, hexagonal, square or polygonal cylinder 102.

In all three cases mentioned for how to prevent piston rotation, peripheral sealing must be used, which is relatively problematic because establishing sealing is difficult.

The sealing problem may be addressed by using a piston ring or rings, disposed in grooves around the piston. The piston and piston ring may be shaped hexagonally, for example, to deal with the sealing and piston rotation problems. Although loose (rather than tight) seals may be wanted (as explained above), it will be appreciated that some degree of sealing is required for workable vacuum usage.

Referring to FIGS. 1, 1A, 1B, when reciprocating the piston 104 (i.e., moving the piston rod 100 and associated piston 104 left-to-right and right-to-left), there arises the repeated need to accelerate and stop, accelerate and stop the piston, which operations necessarily use energy and limit speed. The reciprocating motion is seen as speed-limiting. Preferably, the limitations of the reciprocating motion are minimized, such as by including a spring positioned at the end of a reciprocating cycle, to "assist" the piston.

Operation of an inventive device as shown in FIG. 1 is now discussed, referring also to FIGS. 1A, 1B. Piston 104 has surfaces 104R, 104L. Piston surface 104L defines a left interior chamber inside cylinder 102; piston surface 104R defines a right interior chamber inside cylinder 102. The inventive device of FIGS. 1, 1A, 1B is "double-double-acting" in that one side of the device is always pulling vacuum, as long as the piston 104 is moving; one side is always pumping out residue, as long as the piston 104 is moving.

When the vacuum device of FIG. 1 is in operation, residue is traveling through tube 111X in a direction towards intake 110L or intake 110R, with the direction of the residue flow determined by whether the piston 104 is moving left to right or right to left.

In FIG. 1A, the piston 104 is at a position in its cycle left of a center-point of the cylinder 102, that is, the piston 104 is closer to the valves 110L, 120L than to the valves 110R, 110R. In such as part of the cycle as shown in FIG. 1A, residue flows in through residue entry 111X and naturally takes the residue flow path shown, towards the flapper valve, left intake 110L which is open. Meanwhile, valve 120L is closed; flapper valve, right intake 110R is closed; and valve 120R is open. As shown in FIG. 1A, when the piston 104 is moving left to right, residue falls out of valve 120R or is piped out of valve 120R into a collection bin (not shown).

FIG. 1B shows operation when the piston 104 is moving right to left, in which case residue flows in through tube 111X and travels in a residue flow direction towards intake 110R which is open. Meanwhile, valve 120R and valve 110L are closed, and valve 120L is open, with residue exiting via valve 120L (such as into a collection bin).

An example of a speed for an inventive vacuum device including a reciprocating piston as in FIGS. 1, 1A and 1B is, e.g., 1 second for a left-to-right cycle. This is an example and the vacuum device may be operated at other lower and higher speeds.

In operation, a device according to FIGS. 1, 1A and 1B has a wide range of applications, such as, e.g., household vacuum cleaning, industrial vacuum cleaning, transporting solid residue, transporting liquids, etc.

Opening and closing of valves 110L, 110R, 120L, 120R in FIGS. 1A and 1B occur because of the action of the residue. In the present invention, the residue flow direction has been manipulated so that an inventive positive displacement vacuum device is provided. The seemingly insurmountable problem of conventional positive displacement vacuum devices, namely, that they could not process sufficient volume of residue, has been overcome in the present invention by the novel approach of using both sides of a piston, such as by using sides 104R, 104L of piston 104 in FIGS. 1, 1A, 1B. Herein, such use of both sides of a piston is referred to a as "double acting."

In a piston-actuated embodiment of the invention, the vacuum cleaner piston may be of a short or long length in various embodiments. In an alternative embodiment, the piston can be so short as to be a diaphragm that wobbles back and forth. With a diaphragm structure, there is a limit on the stroke that can be produced by a (flexible) diaphragm.

Figure 2:
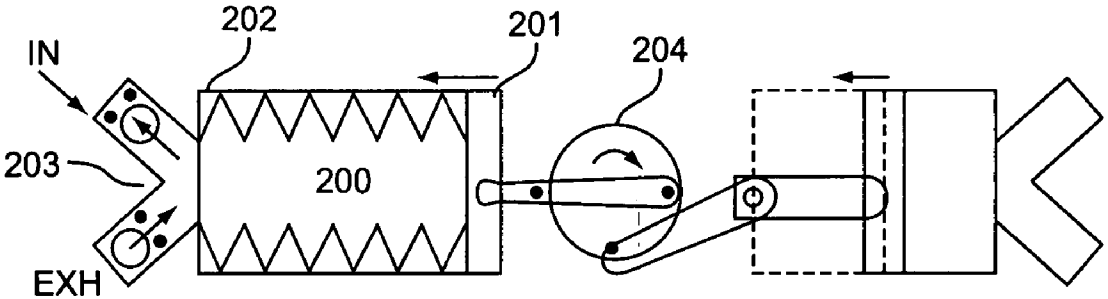
FIGS. 2 and 2A show cross-sectional views of inventive embodiments in which respective bellows structures are used.
Figure 2A:
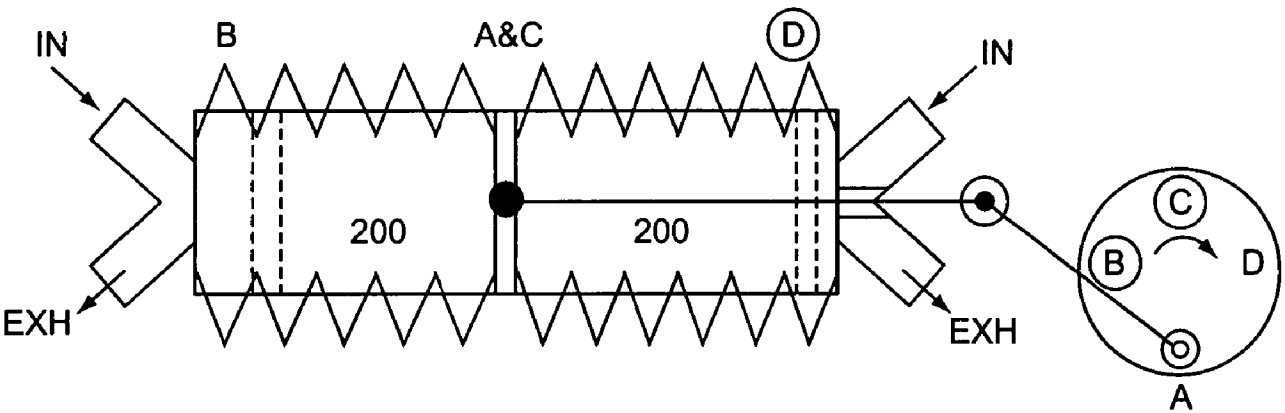

A variation of a diaphragm structure is a bellows arrangement (such as shown in FIGS. 2 and 2A), with the bellows being like an elongated diaphragm. As shown in FIGS. 2 and 2A, one end of a bellows 200 is secured to a plate 201. The other end of the bellows 200 is secured to another plate 202. The plates 201, 202 are moved in and out. Check valves 203 (usually spring loaded balls with light spring pressure) are included. The angled arrows in FIG. 2 represent spring force. On FIGS. 2 and 2A, IN means intake and EXH means exhaust. Intake IN travels in one direction and sucks air (or whatever is being sucked) in, and exhaust EXH travels in the other direction.

In FIG. 2, as one variation, a rotating cranking mechanism 204 is disposed between two opposite bellows 200.

In FIG. 2A, another variation of an inventive bellows arrangement is shown, having two intakes IN and two separate bellows chambers 200.

A bellows arrangement (such as in FIG. 2 or 2A) avoids a problem that otherwise may occur if using a typical piston as in the above-mentioned inventive piston-including vacuum device, namely, a problem that pistons could have particles abrading seals, or abrading walls themselves. A bellows arrangement avoids this particle abrasion problem, because the only moving parts in the bellows arrangement are the check valves (such as check valves 203 in FIG. 2).

An inventive vacuum cleaner device (such as, e.g., one according to FIG. 1, FIG. 2 or 2A) can be operated to provide high vacuum, at a low volume of material handled. However, the inventive vacuum cleaner also can be scaled up volume-wise, to provide a high vacuum, at a high volume of material handled, depending on scale. Scale-up to provide high volume handling can be accomplished by increasing bellows diameter and/or length.

A vacuum cleaner according to the invention (such as one, e.g., according to FIG. 1, FIG. 2, FIG. 2A, etc.) has an advantage over conventional vacuum cleaners from an audio perspective, in that the audio siren scream of a conventional vacuum cleaner is eliminated. The inventive vacuum cleaner can be operated at relatively low speeds (such as, e.g., 1-2 strokes per second) because in the positive displacement structures of the invention, slip is not a factor.

In operation, an inventive vacuum cleaner device (such as one according to FIGS. 1, 1A, 1B; FIG. 2 or 2A) may provide superior performance compared to performance available from conventional impeller vacuum cleaners, because of the hard vacuum provided without the high rotational speeds of the impeller vacuum cleaners. It naturally might be asked why non-impeller vacuums have not previously emerged. It should be appreciated that the impeller concept is relatively mechanically simple, and can be accomplished with a compact, inexpensive motor. For home use, a vacuum cleaner that is small and not heavy has been demanded. These consumer preferences to date seem to have caused household vacuum cleaners to be limited to impeller technology, or at least mostly so.

Referring to FIGS. 1, 1A, 1B, the present inventor considered various embodiments and variations, and particularly provided for a double-acting piston in a vacuum device wherein the piston is a rotary piston. Some examples of rotary piston devices generally (not vacuum devices) have been provided in the past, such as an engine developed by Felix Wankel which at the time the present inventor observed in demonstration. Another example of a rotary piston device has been the rotary engine used in certain Mazda sports cars, which is a continuously moving rotary device which is trochoidal. Almost anyone in the mechanical arts to whom it might be suggested the possibility of using such a rotary piston device as a vacuum cleaner engine would think that great complexity and cost would be involved, and that problems with seals would be onerous.

Figure 4A:
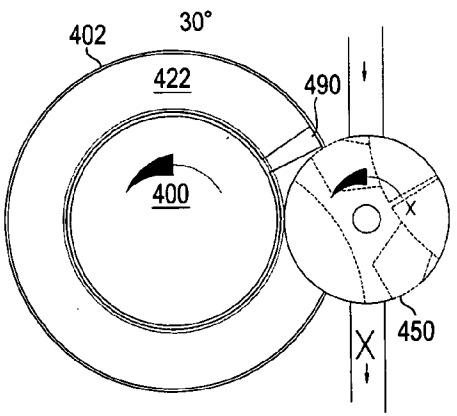
FIGS. 4A-4F are cross-sectional views of an inventive tongued rotary piston vacuum device in an operation sequence. Degree notations (such as 30° etc.) on FIGS. 4A-F are approximate.

However, in the present invention, surprisingly, a rotary piston vacuum device (including appropriate sealing) has been provided, such as, e.g., the rotary piston vacuum device of FIGS. 4A-F). Referring to FIG. 4A, a rotary piston 400 fits, with a fairly tight fit, in a hollow cylindrical chamber 402. A bearing structure is used to keep the rotary piston 400 centered in place. Inner area 422 of chamber 402 is hollow and tongue 490 moves through hollow space 422. (FIG. 4A) In the particular embodiment shown in FIGS. 4A-F, the rotary piston 400 and tongue 490 are shown as having counter-clockwise movement, but it will be appreciated that this movement direction is for illustration and that in another embodiment movement of a rotary piston and tongue may be clockwise. Referring to the structure and operation of FIGS. 4A-F, the amount of vacuum will be proportional to the size of the rotating structure.

A rotary valve 450 is included (FIGS. 4A-F.) Referring to FIGS. 4A-F, the axis of the rotary piston 400 is parallel to the axis of the rotary valve 450, with both axes coming perpendicularly out of the page.

Figure 3:
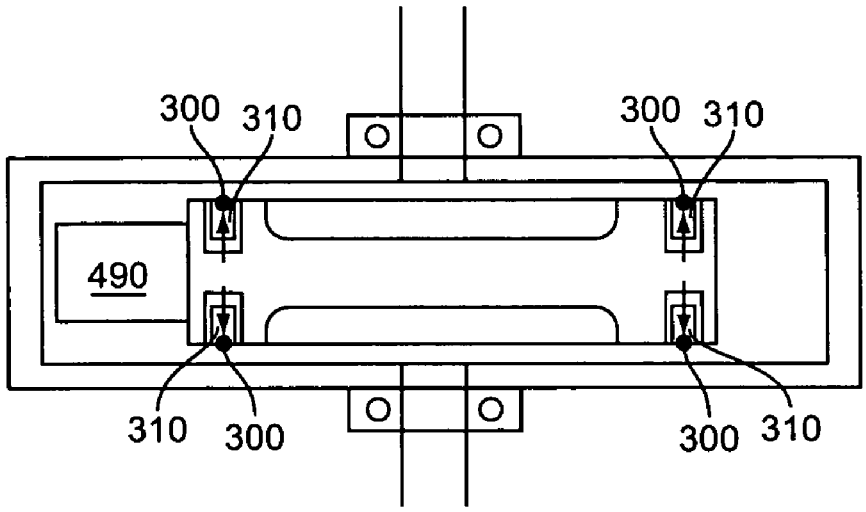
FIGS. 3, 3A show an embodiment of the invention that are cross-sectional views of sealing a rotary piston device, with FIG. 3A being a close-up of part of FIG. 3.
Figure 3A:
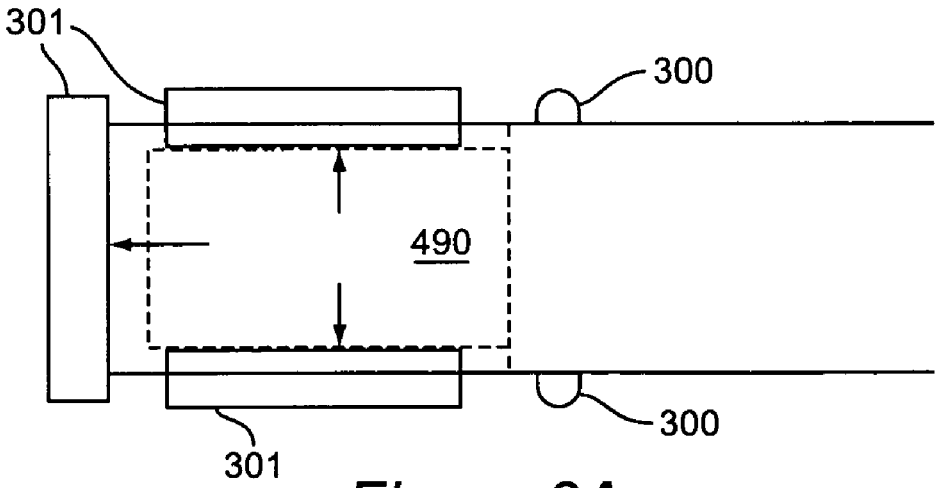

Sealing pertinent to a vacuum device in which a rotor is disposed in a short hollow closed cylindrical may be appreciated with reference to FIG. 3, in which two ring-shaped rotary seals 300 are shown, with each rotary seal 300 having a corresponding annular groove 310. Each rotary seal 300/annular groove 310 combination is spring loaded in a vertical direction, quite close to the periphery. FIG. 3A shows a close-up of FIG. 3, including three seals 301. When seals such as seals 300 and 301 are used, almost any shape can be used for the interior of the hollow cylinder. It will be appreciated that the cylinder will have a hollow part, because if the cylinder had a solid interior, there would be nowhere for particles to go. Once seals 300, 301 are provided to seal the rotary piston device, internal air volume is captive. In FIGS. 3 and 3A, tongue 490 corresponds to tongue 490 in FIGS. 4A-F, except that tongue 490 is shown in a larger view in FIG. 3, and even larger view in FIG. 3A, compared to FIGS. 4A-F. Spring loaded Teflon pieces which project and push against respective upper wall, lower wall and outer wall as shown by the arrows projecting from tongue 490.

The cylinder 402 (referring to FIGS. 4A-F) may be considered as a static pancake shaped enclosure. Importantly, the rotary piston 400 is formed to have a tongue 490. As shown in FIGS. 4A-F, in operation, the tongue 490 of the rotary piston 400 pushes air and creates a vacuum behind the tongue 490 as the tongue 490 rotates through 360 degrees. Meanwhile intermittent rotation of the rotary valve 450 occurs. An example of a rotary valve 450 that may be used is, e.g., a synchronizing mechanism such as a Geneva mechanism. A Geneva mechanism is well known in the mechanical arts and is a type of gear that allows continuous rotary motion of one element to cause intermittent rotary motion in its counterpart.

At about a 30 degree position of the tongue 490 (FIG. 4A), the rotary valve 450 starts moving on a 180 degree segment. The start of the movement of the rotary valve 450 is quick.

Figure 4B:
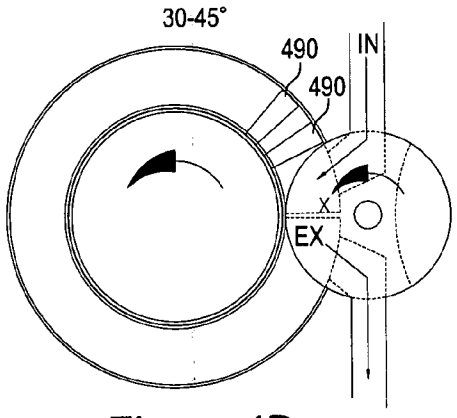

Referring to FIG. 4B, the tongue 490 is shown at positions of 30-45 degrees. (Although the tongue 490 is shown twice in FIG. 4B for defining the respective 30 degree and 45 degree points, it will be appreciated that there is only one tongue 490.) When the tongue 490 is at a position of 30-45 degrees, the rotary valve 450 (having moved its 180 degree segment) is stopped. Valve-stoppage/Cavity-block is provided at this phase of the cycle. The fully closed valve 450 has two passages in it. There is an "in" passage IN for suction of air and anything else entering. (FIGS. 4B, 4C) Anything already inside will exit EX the other way. (FIGS. 4B, 4C)

Figure 4C:
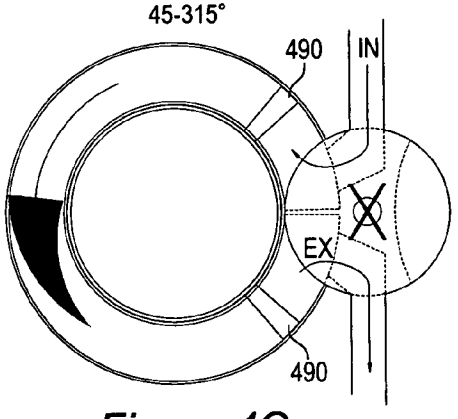

FIG. 4C shows when the tongue 490 is traveling through the 45-315 degrees positions. (Although the tongue 490 is shown twice in FIG. 4CB for defining the respective 45 degree and 315 degree points, it will be appreciated that there is only one tongue 490.) FIG. 4C shows a "closed" Valve position. During a closed Valve position, action (suction and discharge) occurs. Air and/or dust may be the subject of the suction and discharge.

Figure 4D:
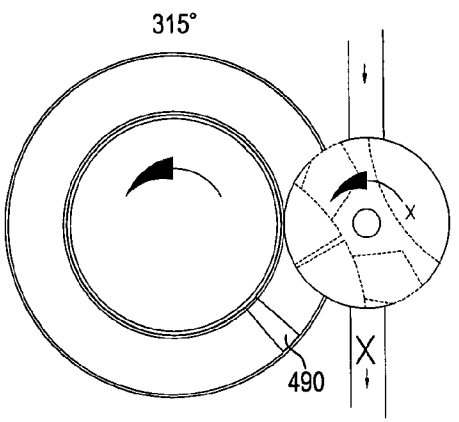
Figure 4E:
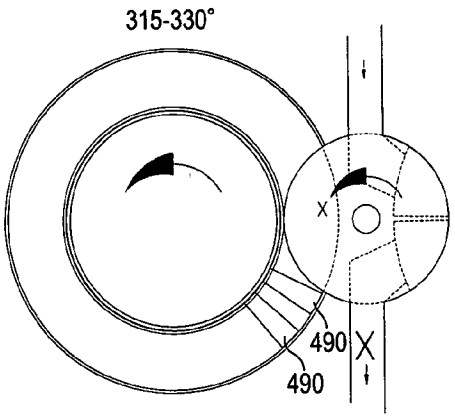
Figure 4F:
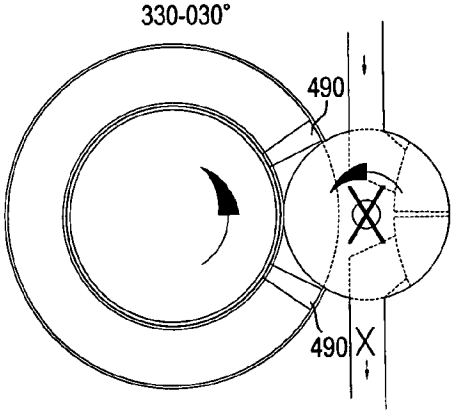

FIG. 4D shows the tongue 490 at a 315 degree position, at which point the rotary valve 450 starts moving 180 degrees, in order to "open" to permit the piston 400 with its tongue 490 to pass by. After moving 180 degrees, the rotary valve 450 stops (FIG. 4E) and the rotary valve 450 is stopped while the tongue 490 is at the 315-330 degree positions of the tongue's cycle. When the rotary valve 450 is positioned as shown in FIG. 4E, the piston 400 with its tongue 490 can pass by. The rotary valve 450 is stopped (FIG. 4F) while the tongue 490 is at positions 330-30 degrees of the tongue's cycle. In FIG. 4F, the fully open position is shown.

Referring to FIGS. 4A-F, in which toroidal half-shells are used, and the piston 400 is solid to the inner ring, with a Geneva mechanism used for the rotary valve 450, rotational "loss" is approximately 60-90 degrees, equaling (in percentage terms) about 16-25%. The "loss" herein refers to the interval between the fully open and fully closed positions, or vice versa. "Loss" is necessarily the price paid for the relative mechanical simplicity of the embodiment shown in FIGS. 4A-F. The nature of the action is pulsating action, with a 60 degree minimum loss of vacuum per rotational cycle. The maximum loss of 25% corresponds to vacuum being created during 75% of the rotational cycle.

Preferably, the cycle shown in FIGS. 4A-F is operated relatively quickly. However, relatively speaking, there will still be a certain percentage "loss." An approach for reducing loss may be by inserting one-way check valves in two places.

Referring to FIGS. 4A-F, it would be wanted to provide greater volumetric efficiency, i.e., for the same volume, lower loss would be desirable. Meanwhile, simplicity is still wanted. The present inventor has considered these features which may be theoretically desirable and has practically provided improvements, which may be seen referring to FIGS. 5-5M (MM).

Figure 5C:
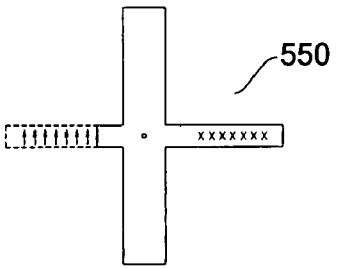
FIG. 5C is a top view corresponding to FIG. 5B.
Figure 5B:
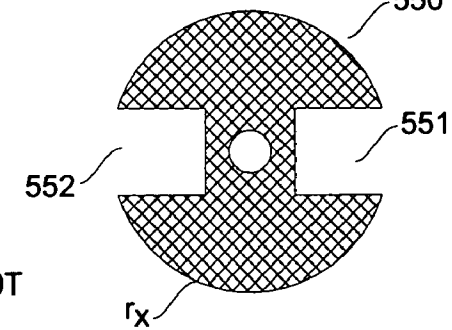
FIG. 5B is a side view of an inventive embodiment of an intersecting rotary-plate style valve.

A modified rotary piston 500 is provided. (FIGS. 5, 5A) The rotary piston 500 includes drive shafts 500S. In FIG. 5A, the small circle in the center depicts the top end of the shaft 500S viewed from above. The rotary piston 500 in FIGS. 5, 5A preferably is solid (as shown by the diagonal lines) to the inner ring. An example of a size of a rotary piston 500 is about 1 inch by 1 inch. Shafts 500S project through the cylindrical shell (FIG. 5D, 5E) in which the rotary piston 500 is housed.

The radius $r_x$, on the outer surface of the cylindrical part of the rotary piston 500 (FIG. 5) corresponds to the radius $r_x$, of the valve 550 (FIG. 5B) to be used with the rotary piston 500. The rotary piston 500 is composed of the rotary piston tongue 500T and hub 500H.

The rotary piston 500 preferably has curved edges. The rotary piston 500 is so shaped because the peripheral concave surface of the piston 500 provides sealing against the convex profile of the edge of the rotary valve 550. A segment of a piston ring (such as a Teflon piston ring segment) may be used around the peripheral parts of the rotary valve 550.

Figure 5:
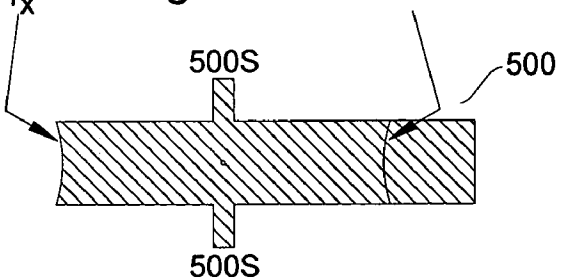
FIG. 5 is a top view of an inventive embodiment of a rotary piston with two drive shafts.
Figure 5A:
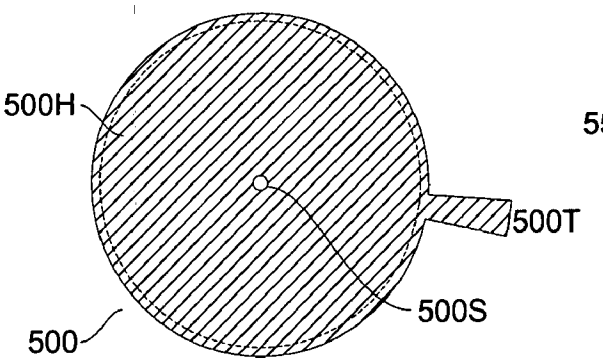
FIG. 5A is a side view corresponding to FIG. 5.
Figure 5D:
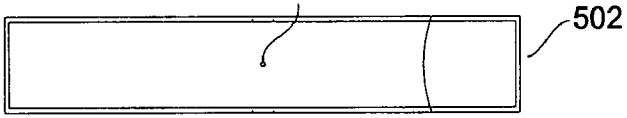
FIG. 5D is a side view of an inventive cylindrical shell.
Figure 5E:
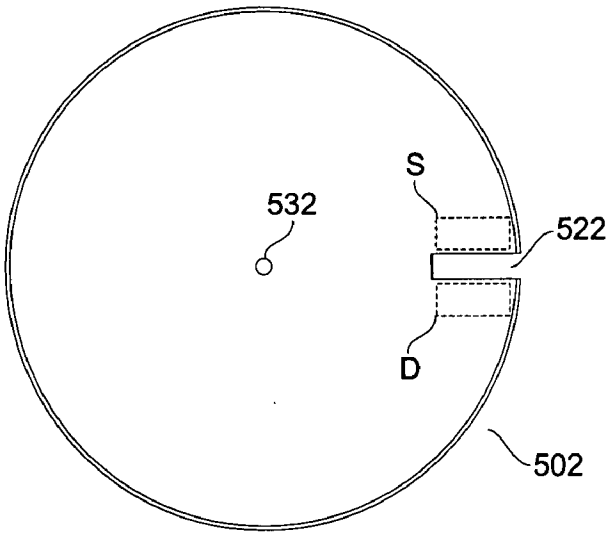
FIG. 5E is a top view corresponding to FIG. 5D.

The rotary piston 500 (FIGS. 5, 5A) is used with the rotary valve 550 (FIGS. 5B, 5C) and the cylindrical shell 502 (FIGS. 5D, 5E). A synchronizing mechanism such as a Geneva mechanism may be used for the rotary valve 550. The diameter of the rotary valve 550 should be such that an opening is made for complete fly-by of the rotary piston 500.

In FIGS. 5D, 5E, the cylindrical shell 502 is a plain hollow cylinder, with the two ends capped, notched at one side at notch 522. The notch 522 is removed from the cylinder 502 to permit intersection with the rotary valve 550. (The cylindrical shell 502 in other embodiments may be modified as different shapes, such as toroidal/square-oidal half-shells.) A shaft hole 532 is provided in the cylindrical shell 502. (Preferably bearings (not shown) are located above and below the shaft hole 532 and engage a shaft of the rotary piston 500 to keep the rotary piston 500 centered.) The cylindrical shell 502 includes suction port S and discharge port D, FIG. 5E, (which are roughly rectangular holes). When assembled, suction ports S and D are right next to the rotary valve 550. Tubular structures are used in connection with each of suction ports S, D. Optionally check valves may be included, as a desirable feature.

In an alternate embodiment (not shown), the rotary valve 550 may be made thicker, and internal passages may be added to the rotary valve 550 to act as Suction and Discharge ports.

The parts shown in FIGS. 5-5E may be used together in an inventive intersecting rotary-plate style valve assembly, as a vacuum cleaner, in which case rotational "loss" of vacuum is calculated to be about 24 degrees, equaling about 6.6%. Suction port S and discharge port D may have flapper valves if desired, to supplement sealing of ports S, D during valve 550 transitions.

When the parts of FIGS. 5-5E are assembled into a vacuum cleaner assembly as shown in FIGS. 5F-M (and FIGS. 5FF-MM), the rotational axis of the rotary valve 550 is 90 degrees offset from the rotational axis of the rotary piston 500. The rotary valve 550 (FIG. 5B) having two notches 551, 552 only has to move 90 degrees per increment (as contrasted to the valve 450 (FIGS. 4A-F) which had to move 180 degrees per increment). The notches 551, 552 will be considered with regard to the notch 522 of the cylinder 502, with the notch 502 being so that the cylinder 502 and the rotary valve 550 can intersect. A mechanism is included to positively synchronize the action of the rotary valve 550 and the rotary piston 500.

Referring to FIGS. 5F-M (and corresponding FIGS. 5FF-5MM), a sequence of an inventive vacuum cleaner in operation is shown. FIGS. 5F, 5FF represent a position of the rotary piston 500 of about 9 degrees, with 0 degrees taken as when the rotary piston 500 is pointed directly at the rotary valve 550. The degree notations for the movement of the rotary piston 500 may be taken as approximate and not necessarily precise. X denotes that the rotary valve 550 starts to move from zero motion. In FIGS. 5F, 5FF, the rotary valve 550 starts on its movement of ninety degrees.

FIGS. 5G, 5GG show about 9 to 12 degrees for the position of the rotary piston 500. The rotary valve 550 moves 90 degrees and then stops.

FIGS. 5H, 5HH show about 12-348 degrees for the position of the rotary piston 500, during which time, the rotary valve 550 is stopped.

In FIGS. 5I, 5II, there is shown about the 348 degree position of the rotary piston 500. The rotary valve 550 starts moving 90 degrees, i.e., the rotary valve 550 starts to move into an open position.

In FIGS. 5J, 5JJ, the rotary piston is at the 348 to 352 degree position. The rotary valve 550 moves 90 degrees and stops.

In FIGS. 5K, 5KK, the rotary piston 500 is at about the 352 degree position, and the rotary valve 550 is stopped. In FIGS. 5K, 5KK, the "door" is open for the rotary piston 500 to move by.

In FIGS. 5L, 5LL, the rotary piston 500 is at about the 360 degree position, and the rotary valve 550 is stopped. In FIGS. 5M, 5MM, the rotary piston 500 is at about the 8 degree position, and the rotary valve 550 is stopped.

In operation, assembly of FIGS. 5-5M (5MM) including the rotary piston 500 with the drive shaft only loses vacuum during about 24 degrees of the rotational movement of the rotary piston 500, which equates to a loss of vacuum of about 6.6% which is a low loss. The loss is low because of manipulating where the diameter of the rotary valve 550 points, namely, not pointing in a direction that gives up vacuum. The huge reduction in loss to 6.6% in the embodiment of FIGS. 5-5M from the greater loss in the embodiment of FIGS. 4A-F is very significant. The rotary valve 550 (FIGS. 5B, 5C, 5F(FF)-M(MM)) can be relatively light weight and therefore easily accelerated and stopped, therefore more work can be gotten out of the same amount of energy put into the inventive system of FIGS. 5F-M compared to the inventive system of FIGS. 4A-F. In operation, the inventive vacuum cleaner assembly of FIGS. 5-5M (MM) demonstrates a pulsating action, with a relatively high (about 83.4%) duty cycle.

The faster the rotary piston 500 can be operated, the more performance (i.e., vacuum suction) that can be produced from a small package.

Sealing for the assembly of FIGS. 5-5M (MM) may be accomplished according to FIGS. 3, 3A, and additional seals can be built into the rotary valve 550 and its interface to the notch 552 in the cylindrical shell 502.

Figure 6:
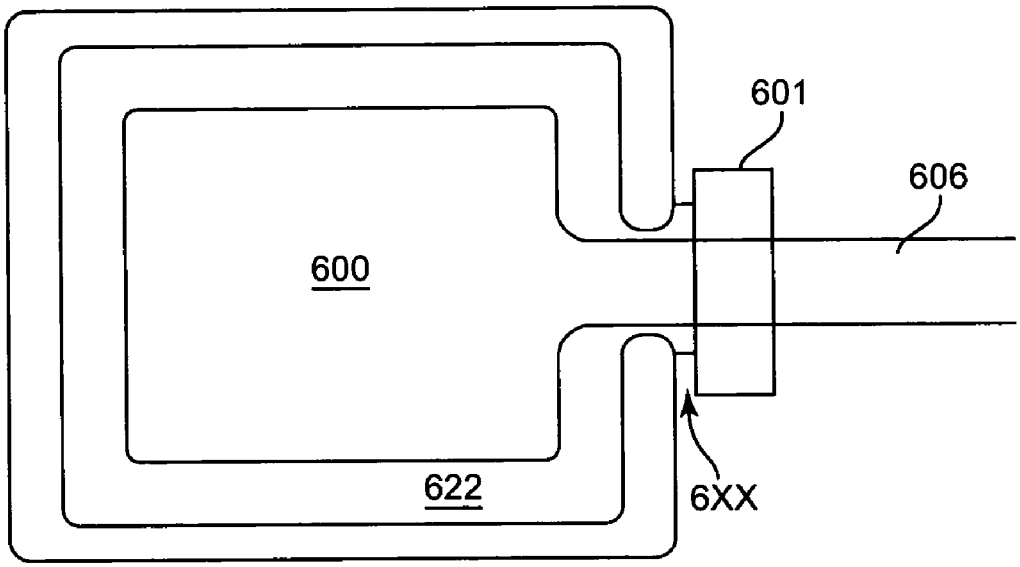
FIG. 6 is a side cross-sectional view depicting problematic air leakage and problematic sealing for a rotary piston.

It should be appreciated that, before the present invention, in constructing any sort of a vacuum device including a rotary piston 600, it always was wanted to prevent air from leaking past the opening for the "rod" 606, and into the annular opening 6XX as shown in FIG. 6 using sealing 601. Rod 606 is the equivalent of a piston rod in a conventional piston pump or engine. However, for any conventional vacuum device, a satisfactory way of providing sufficient sealing all the way around the piston 600 had not been found, with FIG. 6 showing that problem of sealing. Conventionally, there was not a realistic way to seal around the piston rod 606 and have a rotary piston 600. However, the present inventor has solved the problem (referring to FIG. 6) of sealing all the way around the rotary piston "rod" 606 in a rotary piston vacuum device, by the elegant and relatively simple solution shown in FIGS. 5-5M (MM) (which depicts an inventive vacuum device assembly including a rotary valve that operates across 90 degrees). The inventive use of a rotary piston in cooperation with a double-notched rotary valve with the rotary valve operating fully within a 90 degree turn increment, plus the simple geometry of the hollow central cylindrical piston "rod" 606 makes sealing all the way around the piston "rod"

606 unnecessary. Correspondingly, a working vacuum device based on a rotary piston now can be provided.

Above in summarizing the invention it has been mentioned that in an inventive vacuum cleaner, optionally the piston has a hub wherein the piston hub has a peripheral concave surface. It will be appreciated that this "hub" replaces a conventional piston "rod" (and also a conventional crankshaft) the problems of which are discussed in the preceding paragraph. The purpose of the hub (among other things) is to overcome the problem of sealing a "rod" flying around in the otherwise-needed static "slot" to hold and drive the rotary piston.

Figure 7A:
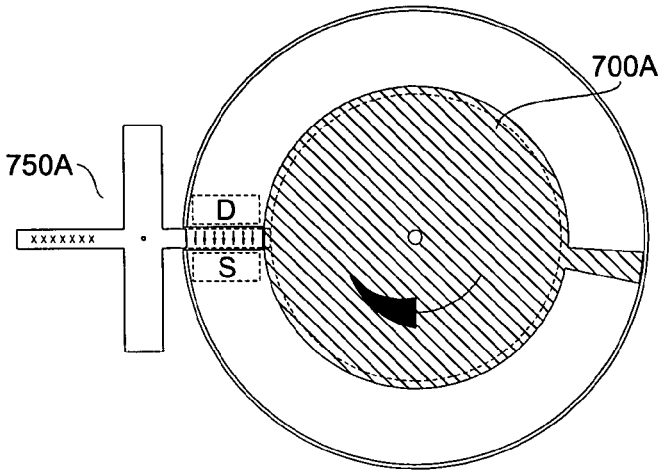
FIGS. 7A, 7B correspond to the respective top assembly and bottom assembly in the stack of FIG. 7.
Figure 7:
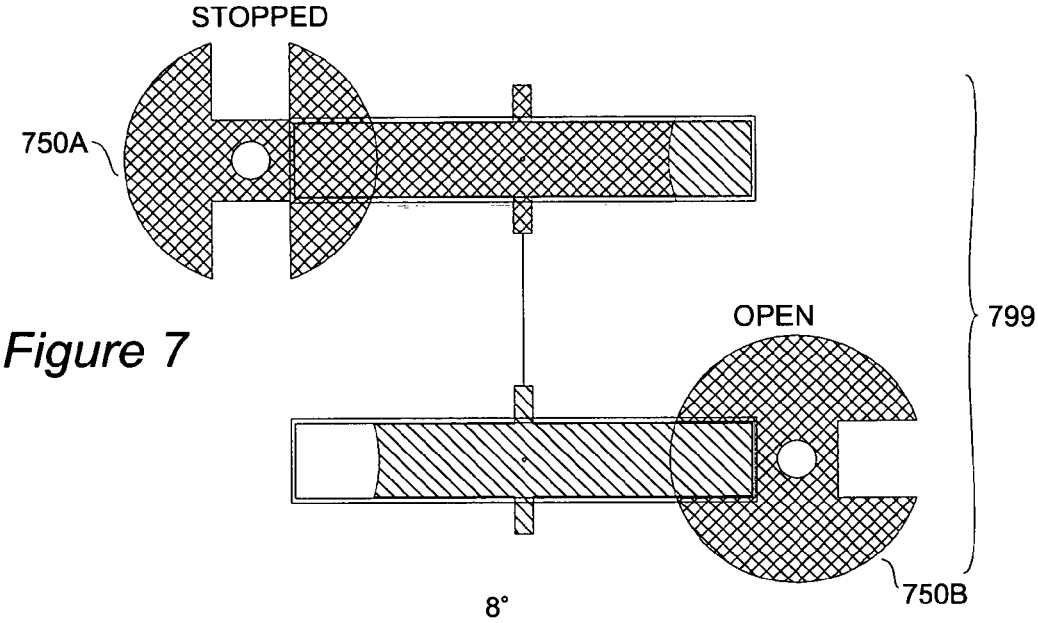
FIG. 7 is a top view in exploded perspective for an inventive embodiment including a stack of two inventive assemblies (such as stacking two assemblies from FIGS. 5-5MM).
Figure 7B:
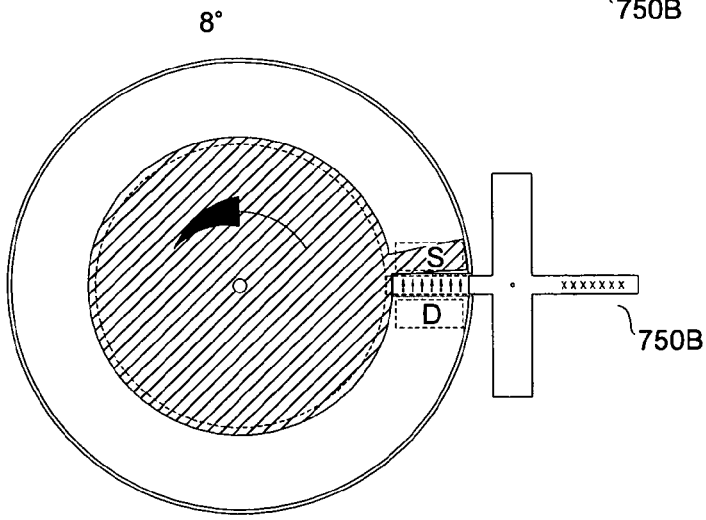

Thus, it will be appreciated that one inventive assembly according to FIGS. 5-M (MM) may be used in a vacuum cleaner. However, to further reduce loss of vacuum, preferably, two or more inventive assemblies are used in a synchronized manner so that when one assembly is dormant, another assembly is not dormant, such as a stack 799 of two assemblies as shown in FIG. 7. In FIG. 7, rotary valve 750B is open (vacuuming) and rotary valve 750A is stopped. Rotary pistons 700A, 700B are according to rotary piston 500 described above with reference to FIGS. 5-5M. FIG. 7 shows a simple stack of two assemblies, with the respective rotary valves 750A, 750B at opposite ends.

In the stack of FIG. 7 including two assemblies, rotary piston 700A and rotary piston 700B are separate parts, rather than being a unitary piston. In FIG. 7, each rotary piston 700A, 700B moves in its own respective chamber. By using the stacked configuration of FIG. 7, double capacity can be achieved and half of the pulsation effect of FIGS. 5-5M (MM) can be eliminated.

More than two assemblies may be stacked, such as a 3-assembly stack, a 4-assembly stack, etc., and there is no particular maximum number of assemblies in a stack. However, with too many assemblies the design may become inelegant. In synchronizing the assemblies within a stack, 180, 90, and 270 degree points are preferred for placement of rotary valves.

Figure 8:
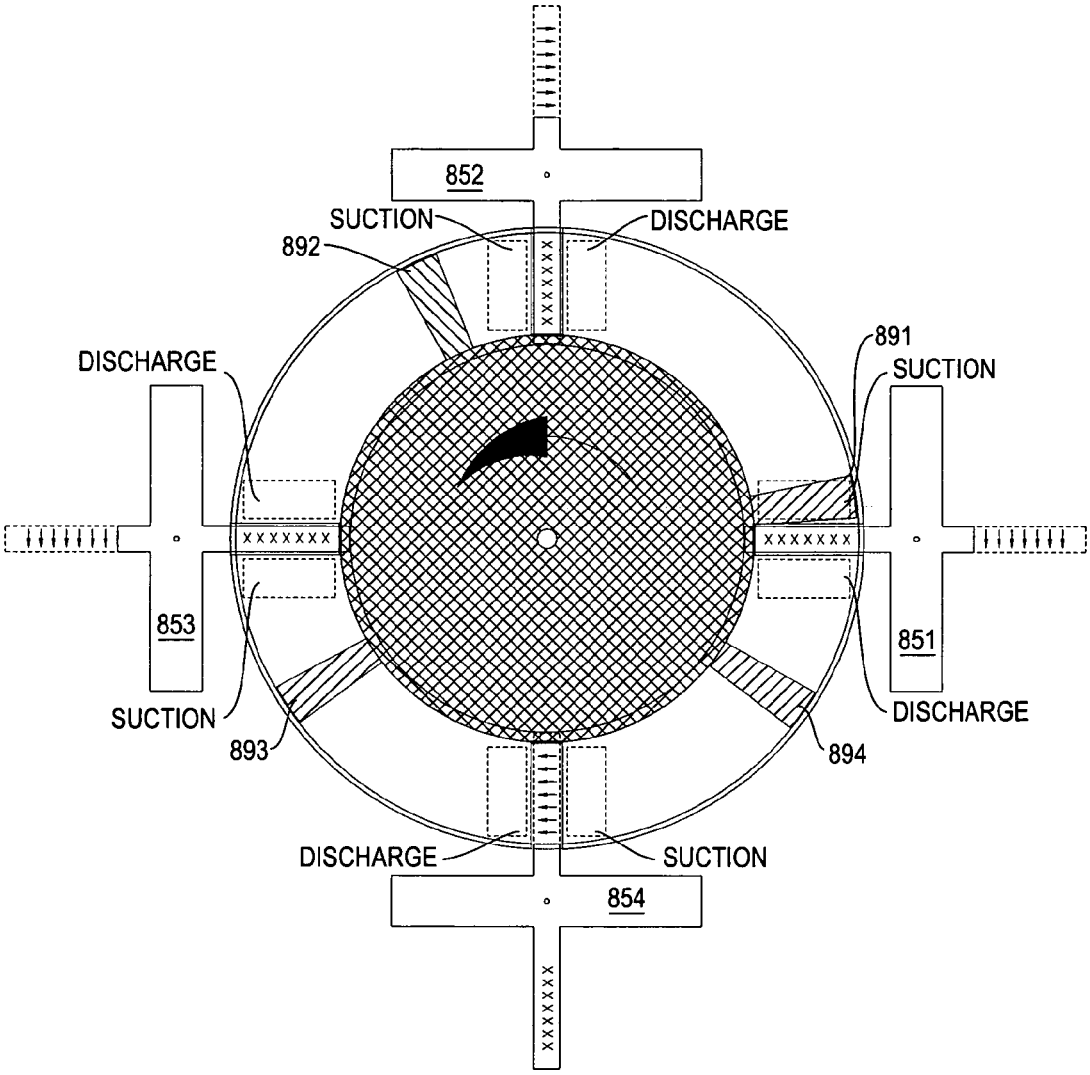
FIG. 8 is a top view, x-ray perspective, of an inventive four-assembly stack, with a staggered valve/tongue arrangement.

Turning to FIG. 8 (in x-ray perspective), an inventive embodiment is shown in which four assemblies are stacked, with the piston tongues 891, 892, 893, 894 being strategically staggered so that dead zones (i.e., times in which no vacuum suction is occurring) are spread out. FIG. 8 thus shows a preferred example of a staggered valve and tongue arrangement. In FIG. 8, rotary valves 851, 852, 853, 854 are shown. (As FIGS. 7 and 8 have been described, "stack" is used to refer to separate chambers being stacked, and not to refer to a single chamber in which multiple pistons act (also referred to as a multiple piston single assembly).)

Figure 9:
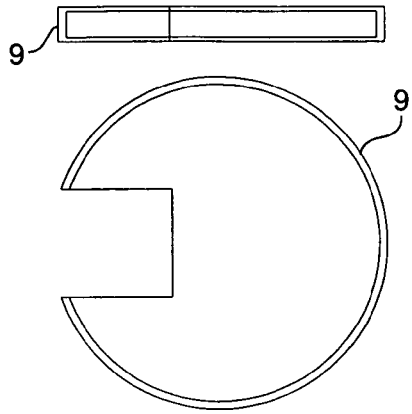
FIG. 9 shows top and side views of an inventive pancake-shaped surround structure for a rotary valve.

Referring to FIG. 9, there is shown a pancake shaped structure 9 to be used surrounding the rotary valve (such as rotary valve 750A, 750B in FIG. 7, rotary valve 851, 852, 853, 854 in FIG. 8; etc.). Valve surround 9 joins to the canister (not shown).

Figure 9A:
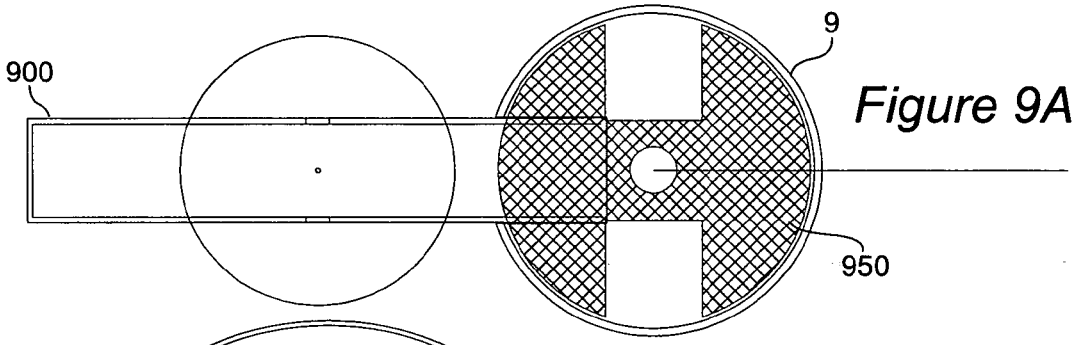
FIG. 9A is a side view corresponding to FIG. 9.

Turning to FIG. 9A, the valve surround 9 is shown from the side. The internal cavity of the valve surround 9 is rounded. The rotary valve 950 fits within the valve surround 9. The rotary piston 900 in FIG. 9A is rotating out of the plane of the paper like a helicopter blade.

Figure 9B:
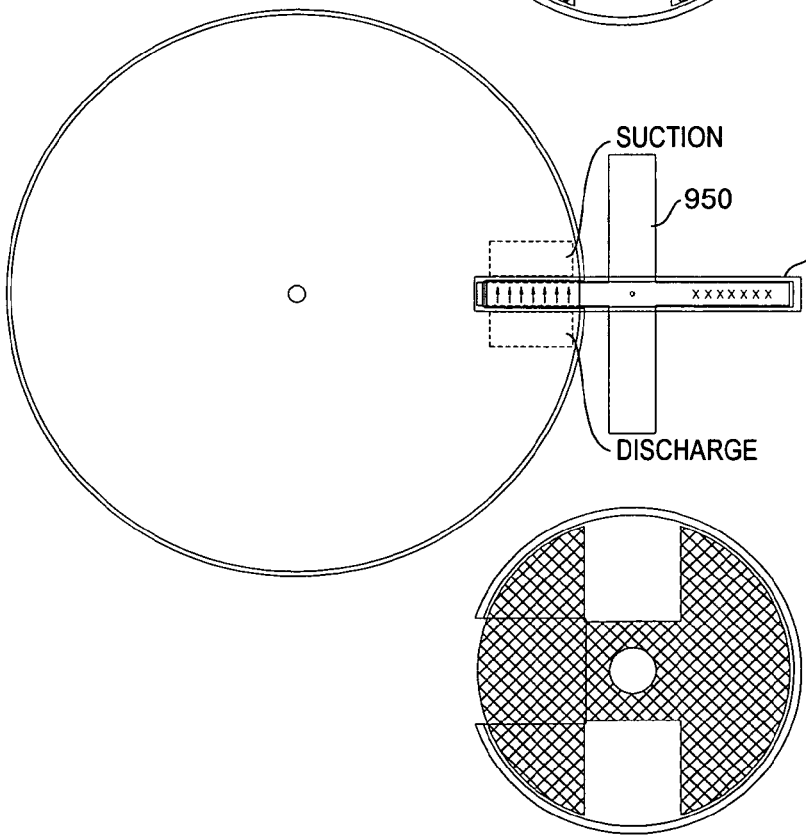
FIG. 9B is another view corresponding to FIG. 9A.

In FIG. 9B, the valve surround 9 is again shown. In FIG. 9B, dashed lines - - - represent cut areas. The valve surround 9 may be welded, bonded or sealed to the canister (not shown). The valve surround 9 keeps stray dust inside the cylinder assembly.

Inventive vacuum cleaner devices as illustrated herein may be used to vacuum liquid, to vacuum dust, to vacuum other materials, etc. The present invention may be used for constructing household vacuum cleaners, commercial vacuum cleaners, etc.

The present invention can be even more fully appreciated by considering that conventional centrifugal vacuum cleaners have an undesirable high frequency siren whine (referring just to the air particle whine, not to the additional motor whine). Very advantageously, the present invention makes possible elimination of that siren whine. While a conventional centrifugal vacuum is usually operated at 8,000-20,000 rpm, vacuum cleaners according to the present invention may be operated in the 100s rpm, and need not be operated in the 1,000s rpm, i.e., the present invention may be operated at an order of magnitude less than the lowest-rpm conventional centrifugal vacuum cleaners.

Also, the present invention can provide very quiet vacuum cleaner performance. Before the present invention, the quietest available vacuum that could be found was the 14 gallon Shop Vac (wet/dry) (commercially available through large hardware retailers, such as Lowe's or Sears), which has a typical sound level of about 75 db. In the present invention, preferably quiet vacuuming of less than 75 db is provided, and more preferably inventive quiet vacuuming of 70 db or less is provided. It should be appreciated that a reduction to 70 db from 75 db is a huge improvement, as every 3 db increment is double the noise.

It will be appreciated that there are great similarities between conventional piston pumps and conventional internal combustion piston engines. While the discussion above focuses on pumps and vacuum devices, it should also be appreciated that in an embodiment the invention also makes possible a new type of rotary combustion engine, preferably, e.g., a rotary combustion engine without any troichoidal or elliptical chamber. The invention makes possible a rotary combustion engine in which the piston follows a pure circular motion, rather than an elliptical or reciprocating motion (as in Wankel or conventional piston engines). To construct an inventive rotary combustion engine, a plurality of rotary valves are arranged to create an intake cycle, a compression cycle, a power cycle and an exhaust cycle. Referring to above FIGS. 5, 7-9, fuel may be drawn in with the air or may be injected during the compression cycle. Rotary valves in the inventive engine embodiment are made of a material and sized to withstand the action of gases exploding.

While the invention has been described in terms of preferred embodiments, those skilled in the art will recognize that the invention can be practiced with modification within the spirit and scope of the appended claims.

Having thus described my invention, what I claim as new and desire to secure by Letters Patent is as follows:

1. A vacuum cleaner device, having an exterior size of no bigger than about 6 inches by 6 inches by 6 inches, and wherein:

no centrifugal impeller is included, quiet vacuuming of 75 db or less is provided, the vacuum cleaner delivers a vacuum suction of at least about 300 inches of water, and a positive displacement vacuum system is included.

* * * * *